US005322157A

United States Patent [19]

Dahlgrün

[11] Patent Number: 5,322,157

[45] Date of Patent: Jun. 21, 1994

[54] APPARATUS FOR TRANSFERRING AND CHANGING THE DIRECTION OF TRANSPORT OF ROD-SHAPED ARTICLES

[75] Inventor: Rolf Dahlgrün, Chaville, France

[73] Assignee: Decoufle S.A.R.L., Chilly-Mazarin, France

[21] Appl. No.: 127,888

[22] Filed: Sep. 27, 1993

Related U.S. Application Data

[63] Continuation of Ser. No. 903,712, Jun. 24, 1992, abandoned.

[30] Foreign Application Priority Data

Jun. 27, 1991 [DE] Fed. Rep. of Germany ..... 4121201

[51] Int. Cl.[5] ..... B65G 17/46

[52] U.S. Cl. ..... 198/471.1; 198/428; 198/475.1

[58] Field of Search ..... 198/428, 471.1, 474.1–477.1

[56] References Cited

U.S. PATENT DOCUMENTS

| | | | |
|---|---|---|---|
| 3,039,606 | 6/1962 | Dearsley | 209/111.5 |
| 3,303,926 | 2/1967 | Pohl | 198/471.1 |
| 3,521,513 | 7/1970 | Gömann et al. | 83/310 |
| 3,567,011 | 3/1971 | Pinkham | 198/471.1 |
| 3,952,865 | 4/1976 | Rudszinat | 198/240 |
| 4,051,947 | 10/1977 | Schumacher et al. | 198/471.1 |
| 4,408,621 | 10/1983 | Schumacher | 198/471.1 |
| 4,645,063 | 2/1987 | Seragnoli | 198/471.1 |
| 4,804,079 | 2/1989 | Hensgen et al. | 198/471.1 |
| 4,827,948 | 5/1989 | Schumacher | 198/471.1 |
| 5,054,346 | 10/1991 | Heitmann | 83/100 |
| 5,255,777 | 10/1993 | Pawelko | 198/471.1 |

*Primary Examiner*—Joseph E. Valenza
*Attorney, Agent, or Firm*—Darby & Darby

[57] ABSTRACT

Apparatus for transferring cigarettes from a file of coaxial cigarettes issuing from a rod making machine into a filter tipping machine has a rotary transfer conveyor with equidistant receivers which are maintained in parallelism with the cigarettes of the file while orbiting about an axis parallel to the axes of the cigarettes in the file. The receivers accept single cigarettes or pairs of cigarettes from the file and deliver them to a transfer station between the transfer conveyor and a rotary removing conveyor having closely adjacent receivers parallel to and serving to receive cigarettes from the receivers of the transfer conveyor. The speed of receivers forming part of the transfer conveyor equals or slightly exceeds the speed of cigarettes in the file but can considerably exceed the speed of receivers forming part of the removing conveyor. The cigarettes which are transferred into the receivers of the removing conveyor are advanced sideways, i.e., at right angles to the direction of transport toward the transfer conveyor.

13 Claims, 2 Drawing Sheets

Fig.1
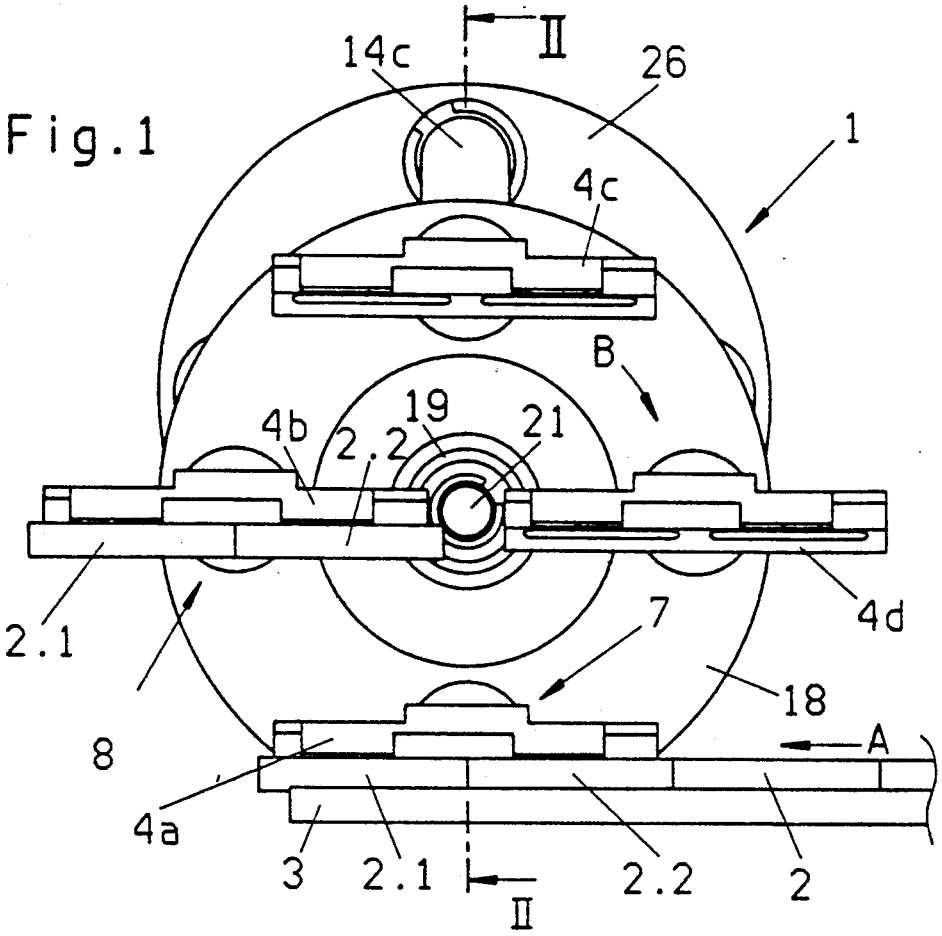
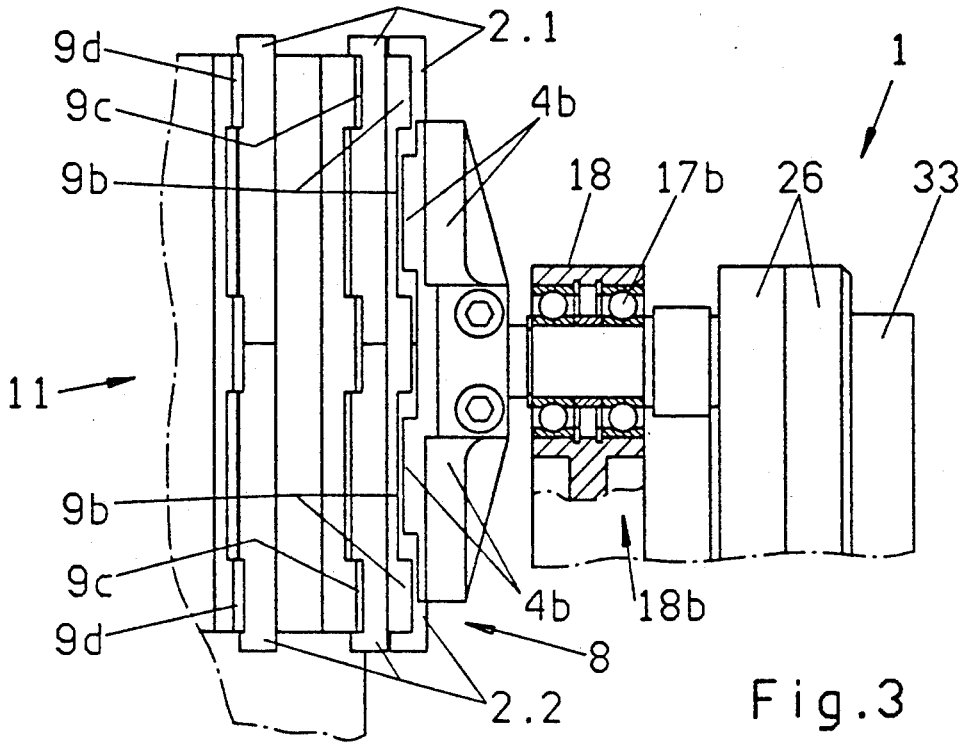
Fig.3

APPARATUS FOR TRANSFERRING AND CHANGING THE DIRECTION OF TRANSPORT OF ROD-SHAPED ARTICLES

This is a continuation, of application Ser. No. 07/903,712, filed Jun. 24, 1992 now abandoned.

BACKGROUND OF THE INVENTION

The invention relates to improvements in apparatus for manipulating rod-shaped articles of the tobacco processing industry. Such articles include plain or filter cigarettes, cigars, cigarillos and cheroots as well as filter rod sections. More particularly, the invention relates to improvements in apparatus for transferring successive individual articles, or successive sets of two or more articles, from an elongated first path wherein the articles are advanced axially (lengthwise) into a second path wherein the articles are advanced sideways, i.e., at least substantially transversely of their respective longitudinal axes.

It is already known to transfer cigarettes or other rod-shaped articles of the tobacco processing industry (hereinafter called cigarettes for short) from a straight first path into a second path with simultaneous change of orientation of the articles by approximately or exactly 90°, i.e., from longitudinal axial movement to sidewise or transverse movement. Such changes in direction of movement of the articles are often necessary during transfer of successively formed individual cigarettes or sets of two or more neighboring axially aligned cigarettes from the discharge end of a cigarette rod making machine into a filter tipping machine wherein plain cigarettes are provided with filter mouthpieces. It is also known to alter the speed of the manipulated cigarettes so that the speed of cigarettes which move sideways is less than the speed of cigarettes which move axially. The means for transferring cigarettes from the first path into the second path normally comprises a rotary conveyor with cigarette receivers which have elongated flutes and are driven in such a way that their speed at the locus of acceptance from the first path matches the speed of cigarettes in the first path. The flutes of the receivers forming part of the rotary conveyor are parallel to the cigarettes during acceptance of single or plural cigarettes from the first path, and such receivers are parallel to the receivers of a conveyor which defines the second path during acceptance of single or plural cigarettes from successive receivers of the rotary conveyor.

U.S. Pat. No. 3,521,513 granted Jul. 21, 1970 to Gömann et al. discloses a transfer apparatus wherein the receivers of the rotary conveyor attract cigarettes from the first path by suction. The thus attracted cigarettes share the movements of the respective receivers along an arc of approximately 90° so that the component of movement in the direction of movement along the first path (i.e., in the axial direction of the cigarettes) is reduced to zero. Successive receivers of the rotary conveyor then transfer the single or plural cigarettes onto a removing conveyor which defines the second path. At the instant of transfer onto the removing conveyor, the receivers of the rotary conveyor are parallel to the cigarettes in the first path as well as to the receivers of the removing conveyor. The speed of receivers on the removing conveyor matches the speed of receivers on the rotary conveyor when the cigarettes enter the second path. Thus, the speed of receivers on the removing conveyor must match the speed of cigarettes in the first path. This is or can be undesirable under certain circumstances, e.g., at the cigarette admitting end of a filter tipping machine.

U.S. Pat. No. 3,039,606 granted Jun. 19, 1962 to Dearsley discloses a cigarette catcher wherein the speed of receivers on the rotary conveyor is higher during acceptance of cigarettes from the first path and is lower during transfer of cigarettes into the receivers of the removing conveyor. A drawback of the apparatus of Dearsley is its complexity. Furthermore, conversion of the patented apparatus for the transfer of shorter or longer cigarettes necessitates the installation of a substantial number of adapters which also contributes to the initial and maintenance cost.

OBJECTS OF THE INVENTION

An object of the invention is to provide an apparatus for manipulating rod-shaped articles of the tobacco processing industry which can reliably transfer single or plural articles of a file of such articles from a first path onto a removing conveyor, with simultaneous change in the direction of advancement of articles, even though the rotary transfer conveyor is driven at a constant speed.

Another object of the invention is to provide a combined article transferring and direction changing apparatus which is at least as reliable as, but simpler and less expensive than, heretofore known apparatus.

A further object of the invention is to provide a novel and improved rotary transfer conveyor for use in the above outlined apparatus.

An additional object of the invention is to provide a novel and improved removing conveyor for use in the above outlined apparatus.

Still another object of the invention is to provide a novel and improved combination of rotary transfer conveyor and removing conveyor for use in the above outlined apparatus.

A further object of the invention is to provide a production line which embodies the above outlined apparatus.

Another object of the invention is to provide a novel and improved apparatus which can transfer cigarettes from a cigarette rod making machine into a filter tipping machine.

An additional object of the invention is to provide the above outlined apparatus with novel and improved receivers for removal or acceptance of rod-shaped articles from the outlet of a rod making machine.

Still another object of the invention is to provide the apparatus with novel and improved receivers for use on the removing conveyor to accept rod-shaped articles from the transfer conveyor.

An additional object of the invention is to provide a novel and improved method of regulating and properly relating the speeds of various conveyors in the above outlined apparatus.

A further object of the invention is to provide an apparatus which can manipulate rod-shaped articles of the tobacco processing industry at the rate they issue from a high-speed maker of plain or filter cigarettes, cigars, cigarillos, cheroots or filter rod sections.

SUMMARY OF THE INVENTION

The invention is embodied in an apparatus for manipulating cigarettes or other elongated rod-shaped articles of the tobacco processing industry, for example, for transferring plain cigarettes from a cigarette rod making machine into a filter tipping machine. The improved apparatus comprises means for advancing a file of axially aligned rod-shaped articles in a predetermined direction at a first speed along a first path, particularly along a straight substantially horizontal path, and a rotary transfer conveyor having at least one article receiver (e.g., a receiver having an elongated flute) arranged to orbit along an endless second path adjacent a portion of the first path so that the at least one first receiver can accept at least one article from the first path during each orbit along the second path. The transfer conveyor further comprises means (e.g., a gear transmission) for orbiting the at least one first receiver along the second path at a second speed which at least approximates the first speed, at least during orbital movement along the aforementioned portion of the first path, and means for maintaining the at least one first receiver in an orientation of at least substantial parallelism with the predetermined direction. The apparatus further comprises a removing or take-off conveyor having at least one second article receiver (e.g., a receiver having an elongated flute) which is at least substantially parallel to the predetermined direction, means (e.g., a cylindrical carrier) for establishing for the at least one second receiver a third path (for example, an endless path) having a portion which is adjacent a portion of the second path, but is spaced apart from the aforementioned portion of the first path, where the at least one second receiver accepts one or more articles from the at least one first receiver, and means for moving the at least one second receiver along the third path at a speed which is different from (particularly less than) the second speed, at least during movement along the aforementioned portion of the second path.

The maintaining means of the transfer conveyor can comprise a first carrier which is rotatable (by the orbiting means) about a first axis, a second carrier rotatable about a second axis which is parallel with and is offset relative to the first axis, and a crank which is rotatably journalled in the carriers and supports the at least one first receiver. The two axes are or can be stationary, and such transfer conveyor further comprises means for connecting a shaft defining the first axis with a shaft which defines the second axis.

The at least one first receiver preferably includes at least one portion which extends into the third path during orbital movement of the at least one first receiver along the aforementioned portion of the second path, and the at least one second receiver has at least one portion which extends into the second path and bypasses the at least one portion of the at least one first receiver during movement along the aforementioned portion of the third path. The maintaining means of such transfer conveyor comprises the aforementioned second rotary carrier which supports the at least one first receiver, and the establishing means of the removing conveyor preferably comprises a further carrier for the at least one second receiver. The further carrier is spaced apart from the second carrier. The at least one portion of the at least one first receiver is preferably spaced apart from the second carrier, and the at least one portion of the at least one second receiver is preferably spaced apart from the further carrier.

At least one of the receivers can be provided or associated with means for pneumatically attracting articles thereto. Such attracting means can comprise at least one suction port which is provided in the at least one first receiver, means for connecting the at least one port to a suction generating device, and means for sealing the at least one port from the suction generating device when the at least one first receiver reaches the aforementioned portion of the second path. In addition to or in lieu of the just described structure, the attracting means can comprise at least one suction port in the at least one second receiver, a suction generating device, and means for connecting the at least one port of the at least one second receiver to the suction generating device not later than when the at least one second receiver enters the aforementioned portion of the third path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a schematic front elevational view of the transfer conveyor and a fragmentary side elevational view of the means for supplying rod-shaped articles to the transfer conveyor;

FIG. 3 is a fragmentary partial plan and partial sectional view of the transfer station between the transfer conveyor and the removing conveyor, substantially as seen in the direction of arrow III in FIG. 2.

DESCRIPTION OF PREFERRED EMBODIMENTS

Figure 2:
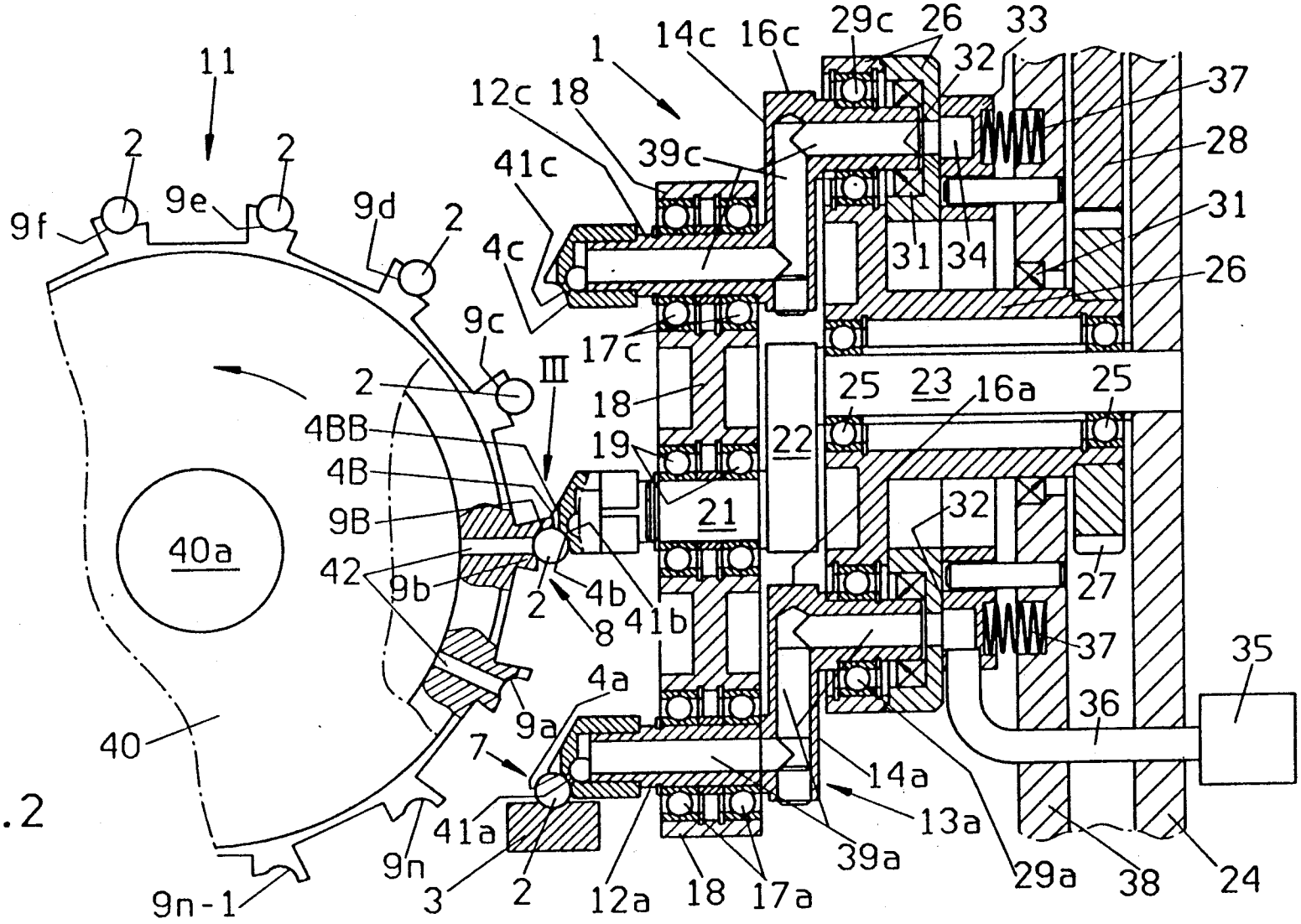
FIG. 2 is a partly side elevational and partly axial sectional view substantially as seen in the direction of arrows from the line II—II in FIG. 1, the removing conveyor being in the process of accepting two coaxial rod-shaped articles from the transfer conveyor.

The transferring and direction changing apparatus which is shown in the drawing comprises an elongated trough 3 forming part of means for advancing a file of plain cigarettes 2 along a substantially horizontal straight path in the direction of arrow A. The trough 3 can form part of a cigarette rod making machine wherein a continuous cigarette rod is severed by a so-called cutoff and the thus obtained file of cigarettes 2 is moved axially (arrow A) at the speed of advancement of the cigarette rod through the severing station. Reference may be had, for example, to FIG. 9 of commonly owned U.S. Pat. No. 3,952,865 granted Apr. 27, 1976 to Rudsinat et al. which shows the discharge end of a rod making machine and means for propelling cigarettes of a single file at a predetermined speed. The apparatus further comprises a rotary transfer conveyor 1 having four fluted receivers 4*a*, 4*b*, 4*c*, 4*d* for pairs of coaxial plain cigarettes 2. Pairs of coaxial neighboring cigarettes 2.1 and 2.2 are shown in FIG. 1, one in the trough 3 and another in the receiver 4*b* of the transfer conveyor 1. The apparatus also comprises a rotary removing or take-off conveyor 11 which is provided with a substantial number of fluted cigarette receivers 9*a*, 9*b*, 9*c*, 9*d*, 9*e*, 9*f*, . . . 9*n*−1, 9*n*. The number of receivers 9 greatly exceeds the number of receivers 4, and the mutual spacing (pitch) of receivers 9 on a rotary cylindrical carrier 40 of the conveyor 11 (as seen in the direction of orbital movement of receivers 9 along their endless path about the axis of the conveyor 11) is less than the mutual spacing (pitch) of receivers 4a–4d adjacent a rotary disc-shaped first carrier 18 of the conveyor 1, as seen in the direction of orbital movement of the receivers 4a–4d about the axis of a horizontal shaft 21 for the carrier 18. Consequently, the shaft 40a for the carrier 40 which mounts the receivers 9a to 9n can orbit the receivers 9a–9n at a speed which is less than the speed of orbital movement of the receivers 4. The reference character 7 denotes a transfer station where a portion of the path of orbital movement of the receivers 4a–4d is sufficiently close to a portion of the straight path which is defined by the trough 3 to enable successive receivers 4a, 4b, 4c, 4d to accept pairs 2.1, 2.2 of plain cigarettes 2 from the trough 3 and to advance them along their endless path in a clockwise direction (arrow B in FIG. 1) to a second transfer station 8 where a portion of the endless path for the receivers 4a–4d is sufficiently close to a portion of the path of orbital movement of the receivers 9a–9n to enable successive receivers 9a, 9b . . . 9n to accept pairs of coaxial cigarettes 2.1, 2.2 from successive receivers 4a–4d.

The speed of the receiver 4a, 4b, 4c or 4d at the transfer station 7 can match but preferably slightly exceeds the speed of cigarettes 2 in the trough 3. This is desirable and advantageous in order to prevent the foremost cigarette (2.1) behind the freshly removed foremost pair 2.1, 2.2 from interfering with sidewise movement of the trailing cigarette (2.2) of such foremost pair during transport by the respective receiver 4a, 4b, 4c or 4d away from the transfer station 7.

A pair (2.1, 2.2) of cigarettes which are attracted by suction to the respective receiver 4a, 4b, 4c or 4d advances with the conveyor 1 along an arc of approximately 90° before such receiver of the conveyor 1 reaches the transfer station 8 and delivers the pair of cigarettes to the oncoming receiver 9a . . . 9n of the removing conveyor 11. Thus, at the time two coaxial cigarettes 2.1, 2.2 reach the second transfer station 8, their speed in the direction of their common axis is zero, and these cigarettes then begin to move in a direction at right angles to the direction of arrow A because the axis of the shaft 41 is parallel to the common axis of cigarettes 2 in the trough 3. The conveyor 11 forms part of or serves to deliver pairs of plain cigarettes to a filter tipping machine (e.g., a machine known as MAX which is distributed by the assignee of the present application) wherein the cigarettes of successive pairs are moved axially and away from each other to provide room for filter rod sections of double unit length. The thus obtained groups of three coaxial rod-shaped articles (two plain cigarettes 2.1, 2.2 and a filter plug of double unit length between them) are thereupon connected to each other by adhesive-coated tipping paper to form filter cigarettes of double unit length, and such cigarettes are thereupon severed midway between their ends to yield pairs of filter cigarettes of unit length. Reference may be had, for example, to commonly owned U.S. Pat. No. 5,054,346 granted Oct. 8, 1991 to Heitmann which describes and shows a filter tipping machine of the type capable of embodying or accepting pairs of cigarettes from the conveyor 11.

Of course, it is equally possible to utilize the removing conveyor 11 as a means for transporting cigarettes 2 in or toward another processing machine, e.g., a packing machine for plain cigarettes, or into storage. For example, the receivers 4a–4d and 9a–9n can be designed to accept and transport discrete cigarettes (rather than pairs of coaxial cigarettes) if they are to transport cigarettes toward a magazine or into a packing machine.

Each of the four receivers 4a to 4d of the transfer conveyor 1 is mounted on the pin 12a, 12b, 12c, 12d of a crank 13a, 13b, 13c, 13d, respectively. Only the cranks 13a and 13c can be seen in FIG. 2. The cranks 13a–13d further comprise arms 14a, 14b, 14c, 14d and second pins 16a, 16b, 16c, 16d, respectively. The pins 12a–12d are respectively mounted in antifriction bearings 17a, 17b, 17c, 17d (only the bearings 17a to 17c can be seen in FIGS. 2 and 3) which are installed in the carrier 18 of the transfer conveyor 1, and the pins 16a–16d are respectively mounted in antifriction bearings 29a, 29b, 29c, 29d (only the bearings 29a and 29c can be seen in FIG. 2) which are installed in a second rotary carrier 26 of the conveyor 1. The carrier 18 is rotatable about the axis of the fixedly mounted horizontal shaft 21 with the interposition of an antifriction bearing 19, and the carrier 26 is rotatable about the horizontal axis of a shaft 23 which is fixedly mounted in a wall 24 forming part of the frame of the cigarette rod making machine or filter tipping machine. Antifriction bearings 25 are provided between the carrier 26 and the shaft 23, and the means for orbiting the retainers 4a–4d through the medium of the cranks 13a–13d and carriers 18, 26 includes a gear train having mating spur gears 27, 28. The gear 27 is rigid with a hub of the carrier 26, and the gear 28 derives motion from the main prime mover of the cigarette rod making machine so that the speed of orbital movement of the receivers 4a–4d is properly synchronized with the speed of axial movement of cigarettes 2 in the trough 3. The reference character 22 denotes a connector between the shafts 21 and 23. The axis of the shaft 21 is parallel with but is laterally offset relative to the axis of the shaft 23.

The carrier 26 has a radially extending surface 32 which is sealingly engaged by the adjacent surface of a stationary valving element 33 forming part of means for pneumatically attracting cigarettes 2 to the receivers 4a–4d during transfer of cigarettes 2 from the station 7 to the station 8, namely from the trough 3 into the oncoming receivers 9a–9n of the removing conveyor 11. Coil springs 37 react against a stationary frame member 38 to bias the valving element 33 against the surface 32 of the carrier 26, and the valving element 33 has an arcuate groove 34 which is connected with a suction generating device 35 (e.g., a fan or a suction pump) by a conduit 36. The length of the arcuate groove 34 is selected in such a way that suction ports 41a, 41b, 41c, 41d (the suction port 41d cannot be seen in FIG. 2) in the respective receivers 4a–4d can attract pairs of cigarettes during orbital movement from the station 7 to the station 8 but the connection between the suction generating device 35 and the suction port 41a, 41b, 41c or 41d is interrupted by the valving element 33 when such suction port reaches the station 8. This ensures that successive pairs of cigarettes can be more readily accepted by the oncoming receivers 9 of the removing conveyor 11. The channel 34 is connected (at times) with the suction ports 41a–41d by way of channels 39a, 39b, 39c, 39d (only the channels 39a, 39c can be seen in FIG. 2) which are machined into or otherwise formed in the respective cranks 13a–13d. Sealing elements 31 are installed between the hub of the carrier 26 and the adjacent parts.

The removing conveyor 11 is also provided with means for pneumatically attracting pairs of cigarettes to the respective receivers 9a–9n during advancement of pairs of cigarettes from the station 8 to the station where the receivers 9a–9n deliver pairs of cigarettes to a further conveyor, not shown. FIG. 2 merely shows two of the suction ports 42 which are machined into or are otherwise formed in the receivers 9a–9n and are connectable to a suction generating device (e.g., to the suction generating device 35) by way of channels (not shown) provided in the carrier 40 and in another valving element (not shown) corresponding to the valving element 33. The arrangement is such that a port 42 is connected to the respective suction generating device as soon as it reaches the station 8, and such port 42 thereupon remains connected to the suction generating device as long as necessary, namely in order to complete the delivery of a pair of coaxial cigarettes 2.1, 2.2 to the point where the receivers 9a–9n are relieved of cigarettes.

The shaft 41 drives the carrier 40 at a speed such that the speed of orbital movement of the receivers 9a–9n along their endless (third) path is less than the speed of orbital movement of receivers 4a–4d of the conveyor 1 along their (second) endless path. In order to avoid collision between the receivers 4a–4d and the oncoming receivers 9a–9n at the transfer station 8, and in order to ensure predictable and reliable transfer of pairs of cigarettes 2.1, 2.2 from successive receivers 4a–4d into the oncoming receivers 9a–9n, these receivers are designed in such a way that at least one portion of the receiver 4a, 4b, 4c or 4d reaching the station 8 extends into a portion of the path of orbital movement of receivers 9a–9n and, at the same time, at least one portion of that one of the receivers 9a–9n which reaches the station 8 extends into the adjacent portion of the path for the receivers 4a–4d. The portion or portions of a receiver 4 reaching the station 8 and extending into the path for receivers 9 does or do not clash with that portion or with those portions of the oncoming receiver 9 which extends or extend into the path for the receivers 4 because such projecting portions of the receivers 4 and 9 at the station 8 are staggered relative to each other in parallelism with the axes of pairs of articles 2.1, 2.2 at the station 8 so that they can readily bypass each other. Consequently, the speed of the receivers 4 at the station 8 can exceed the speed of the receivers 9. A receiver 9 which reaches the station 8 simply strips the pair of cigarettes off the adjacent receiver 4 while the receiver 4 is in the process of overtaking and advancing beyond the receiver 9. Since the port or ports 41 of a receiver 4 reaching the station 8 are sealed from the suction generating device 35 by the valving element 33, while the port or ports 42 of the receiver 9 approaching the station 8 are simultaneously connected to the respective suction generating device, the transfer of pairs of cigarettes from a receiver 4 onto an oncoming receiver 9 is highly predictable and takes place without affecting the appearance and/or other desirable characteristics of the cigarettes. FIG. 2 shows that a portion 9B of the receiver 9b at the station 8 extends into the path of orbital movement of receivers 4 and that a portion 4B of the receiver 4b at the station 8 extends into the path of movement of the receivers 9. The arrangement may be such that the two ends and the central portion of each receiver 4 are provided with cutouts or recesses (one shown at 4BB in FIG. 2) for the projecting portions 9B of the receivers 9, and that the receivers 9 are provided with cutouts or recesses (see FIG. 3) for the projecting portions 4B of the receivers 4.

The mode of operation of the apparatus which is shown in FIGS. 1 to 3 is as follows:

The trough 3 delivers a single file of closely adjacent coaxial cigarettes 2 from the cutoff (not shown) of the cigarette rod making machine. When the foremost pair 2.1, 2.2 of such cigarettes reaches the transfer station 7, they are attracted by the suction ports 41 of the oncoming receiver 4 because such ports are then connected to the suction generating device 35 by way of the corresponding channel 39, groove 34 of the valving element 33 and conduit 36. While approaching the transfer station 7, the oncoming receiver 4 removes from a higher level to a lower level (arrow B in FIG. 1) to thereupon move the attracted pair of cigarettes 2.1, 2.2 to a higher level and toward the transfer station 8. As mentioned above, the speed of a receiver 8 which approaches and moves through the transfer station 7 can match but preferably at least slightly exceeds the speed of cigarettes 2 in the trough 3 in order to ensure that the trailing cigarette 2.2 of the pair 2.1, 2.2 which is being withdrawn from the trough 3 at the station 7 cannot be interfered with by the immediately following cigarette 2 in the trough. As also mentioned above, the receivers 4 can be designed and dimensioned to accept discrete (single) cigarettes 2 or to accept cigarettes of double unit length in lieu of two coaxial cigarettes 2.1, 2.2 of unit length. If the receivers 4 are to transport plain cigarettes of double unit length, such cigarettes are severed in the filter tipping machine to yield pairs of coaxial plain cigarettes.

The cranks 13a–13d and the carriers 18, 26 constitute means for maintaining the orientation of the receivers 4 so that these receivers remain parallel to the cigarettes 2 in the trough 3 while they orbit along the (second) path which is established by transfer conveyor 1. Thus, a pair of cigarettes 2.1, 2.2 at the transfer station 8 remains parallel to the cigarettes 2 in the trough 3 but the speed of such pair of cigarettes in the direction of arrow A is reduced to zero. The projecting portions 4B and 9B of the receivers 4, 9 at the station 8 then cooperate to ensure predictable transfer of cigarettes 2.1, 2.2 into the receiver 9 whose speed is less than that of the receiver 4. The suction ports 41 are disconnected from the suction generating device 35 on arrival at the station 8, and the immediately adjacent suction ports 42 are then connected to the respective suction generating device in order to ensure that attraction of cigarettes to the receiver 4 is terminated and attraction to the receiver 9 begins as soon as these receivers reach the station 8.

The improved apparatus can be put to use under circumstances when it is desirable to transport rod-shaped articles of the tobacco processing industry sideways in such a way that successive articles of the row of such articles are immediately or closely adjacent each other. Filter tipping machines are typical examples of machines in which rows of closely adjacent rod-shaped articles must or should be transported through one or more processing stations. It has been found that the speed of the receivers 4 can greatly exceed the speed of the receivers 9 without affecting the integrity of conveyed rod-shaped articles, even if the speed of the receivers 4 is very high. Of course, relatively sturdy filter rod sections are even less likely to be affected by pronounced differences between the speed of the receivers 4 and 9. Such filter rod sections are transported in a filter tipping machine from a magazine for filter rod sections to a so-called assembly conveyor having flutes for reception of pairs of coaxial plain cigarettes and serving to permit insertion of filter plugs of double unit length between pairs of cigarettes in such flutes. Reference may be had to the aforementioned U.S. Pat. No. 5,054,346 to Heitmann.

Another advantage of the improved apparatus is that the receivers 4 and 9 can move at different speeds during transport past the transfer station 8 by resorting to simple and inexpensive parts, such as the cranks 13*a*–13*d* of the transfer conveyor 1. Moreover, the apparatus occupies little room which is of considerable importance in production lines for rod-shaped articles, and the speed of the receivers 4 can be readily synchronized with the speed of articles 2 in the trough 3, i.e., in the means for advancing articles along the first path leading to the transfer station 7.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating elongated rod-shaped articles of the tobacco processing industry, comprising means for advancing a file of axially aligned articles in a predetermined direction at a first speed along a first path; a rotary transfer conveyor having at least one first article receiver arranged to orbit along an endless second path adjacent a portion of said first path so that said at least one first receiver can accept at least one article from said first path during each orbit along said second path, said transfer conveyor further having means for orbiting said at least one first receiver along said second path at a second speed which at least approximates said first speed, at least during orbital movement along said portion of said first path, and means for maintaining said at least one first receiver in an orientation of at least substantial parallelism with said direction; and a removing conveyor having at least one second article receiver which is at least substantially parallel to said direction, means for establishing for said at least one second receiver a third path having a portion which is adjacent a portion of said second path and where said at least one second receiver accepts articles from said at least one first receiver, and means for moving said at least one second receiver along said third path at a speed which is different from said second speed, at least during movement along said portion of said second path, said at least one first receiver including at least one portion which extends into said third path during orbital movement along said portion of said second path, said at least one second receiver having at least one portion which extends into said second path and bypasses said at least one portion of said at least one first receiver during movement along said portion of said third path.

2. The apparatus of claim 1, wherein said third speed is less than said second speed, at least during movement of said at least one second receiver along said portion of said second path.

3. The apparatus of claim 1, wherein said maintaining means comprises a first carrier rotatable by said orbiting means about a first axis, a second carrier rotatable about a second axis parallel with and offset relative to said first axis, and a crank rotatably journalled in said carriers and supporting said at least one first receiver.

4. The apparatus of claim 3, wherein said first axis is defined by a first stationary shaft and further comprising means for connecting said first shaft with a second stationary shaft which defines said second axis.

5. The apparatus of claim 1, wherein said maintaining means comprises a first rotary carrier supporting said at least one first receiver, said establishing means comprising a further carrier supporting said at least one second receiver and spaced apart from said first carrier.

6. The apparatus of claim 5, wherein said at least one portion of said at least one first receiver is spaced apart from said first carrier and said at least one portion of said at least one second receiver is spaced apart from said further carrier.

7. The apparatus of claim 1, wherein at least one of said receivers comprises means for pneumatically attracting articles thereto.

8. The apparatus of claim 1, wherein said attracting means comprises at least one suction port provided in said at least one first receiver, means for connecting said at least one port to a suction generating device, and means for sealing said at least one suction port from said suction generating device in said portion of said second path.

9. The apparatus of claim 7, wherein said attracting means comprises at least one suction port in said at least one second receiver, a suction generating device, and means for connecting said suction generating device to said at least one port in said portion of said third path.

10. The apparatus of claim 1, wherein at least said portion of said first path is at least substantially straight.

11. The apparatus of claim 1, wherein said third path is an endless path.

12. The apparatus of claim 1, wherein said advancing means forms part of a cigarette making machine.

13. The apparatus of claim 1, wherein said removing conveyor forms part of a filter tipping machine for cigarettes.

* * * * *